United States Patent [19]

Carlton

[11] Patent Number: 4,901,613

[45] Date of Patent: Feb. 20, 1990

[54] DRIVE LINK FOR SAW CHAIN

[76] Inventor: Raymond R. Carlton, 3105 SE. Carlton St., Portland, Oreg. 97202

[21] Appl. No.: 261,409

[22] Filed: Oct. 24, 1988

[51] Int. Cl.[4] ..... B27B 33/14

[52] U.S. Cl. ..... 83/830; 83/831

[58] Field of Search ..... 83/830, 831, 832, 833, 83/834, ; 30/381, 382, 383

[56] References Cited

U.S. PATENT DOCUMENTS

| | | | |
|---|---|---|---|
| 1,642,145 | 9/1927 | Ferguson | 83/834 |
| 2,705,512 | 4/1955 | Wolf | 83/834 |
| 2,736,352 | 2/1956 | Wright | 83/834 X |
| 2,862,533 | 12/1958 | Mall | 83/834 |
| 3,340,911 | 9/1967 | Wolf | 83/832 |
| 3,747,652 | 7/1973 | Meadows | 83/830 X |
| 3,921,490 | 11/1975 | Dolata et al. | 83/834 X |
| 3,929,049 | 12/1975 | Graversen | 83/834 |
| 3,945,288 | 3/1976 | Olmr | 83/834 |
| 4,309,931 | 1/1982 | Alexander | 83/832 |
| 4,414,876 | 11/1983 | Loigerot | 83/832 X |
| 4,807,366 | 2/1989 | Masato et al. | 83/830 |

FOREIGN PATENT DOCUMENTS

| | | | |
|---|---|---|---|
| 1102721 | 5/1955 | France | 83/830 |

*Primary Examiner*—Frank T. Yost
*Assistant Examiner*—Rinaldi Rada
*Attorney, Agent, or Firm*—Kolisch, Hartwell & Dickinson

[57] ABSTRACT

A saw chain with drive or center links which have portions projecting downwardly in the chain bottomed by a pair of spaced prongs. These produce a clearing action of debris that may collect in a saw bar groove receiving the prongs. The prongs are separated by an edge expanse which is indented upwardly from the tips of the prongs.

2 Claims, 1 Drawing Sheet

DRIVE LINK FOR SAW CHAIN

BACKGROUND AND SUMMARY OF THE INVENTION

This invention relates to saw chain and, more particularly, to saw chain featuring improvements in the construction of a drive link normally found distributed along the length of a saw chain.

The usual chain saw includes a frame and motor unit with what is known as a saw bar secured to this unit extending outwardly from the location of a driving sprocket in the motor and drive unit. Saw chain trained over the bar and the sprocket is moved with rotation of the sprocket along the saw bar to produce a cutting action. A chain saw meeting this general description is illustrated in U.S. Pat. No. 4,484,504.

In the usual saw chain, certain links distributed along the length of the chain are referred to as drive links by reason of the fact that these links have downwardly projecting portions which are engaged by the sprocket in the motor and drive unit to be powered with rotation of the sprocket whereby the saw chain is moved along its path. In the saw bar of the chain saw, a channel or groove extends along the top, bottom and tip of the saw bar, and with movement of the saw chain, the downwardly projecting portions of these drive links ride along and within these grooves. During saw chain movement, other portions of the saw chain ride along the edges of the opposed flanges which define opposite sides of a groove, as described.

It is conventional, and reference is again made to U.S. Pat. No. 4,484,504, to provide a prong at the base of a drive link which, with movement of the saw chain, is drawn through the groove described with the prong tending to remove debris, as necessary, from the groove, whereby the saw chain may ride appropriately as it moves along the bar. It is not uncommon in such saw chain to provide a cavity which precedes the prong with the saw moved in its operating direction, with this concavity providing a region where loosened material may lodge to be carried by the moving saw chain away from the saw blade. That part of the drive link which is engaged by the sprocket of the motor and drive unit is an edge in the downwardly projecting portion of the drive link which trails the drive link.

A general object of this invention is to provide a new and improved drive link for saw chain which includes a pair of distinct prongs spaced along the length of the link for producing cleaning, each prong being defined by an upwardly inclined trailing edge whereby any material loosened and upturned by the passage of a prong thereover becomes positioned to be engaged by a following prong and to be swept out of groove by this succeeding or following prong.

More specifically, the invention contemplates a drive link wherein an edge forming the bottom margin of the link between the two prongs described is indented upwardly in the link to form a downwardly facing cavity or pocket whereby material loosened by the first of the prongs in the link is received within and captured within the pocket described when engaged by the following prong. In a link as contemplated, and should the preceding prong or the prong which is in advance ride up over material in a sled-type action, there is a tendency for the link to drop at its trailing extremity whereby the following prong digs in and clears debris with such being captured within the cavity described.

A particular feature and object of the invention is provide a drive link with a prong construction adapted to clear any channel receiving the drive link, which is symmetrically configured with respect to a plane bisecting the link and extending perpendicular to the longitudinal dimension of the link. This is particularly significant in connection with the manufacture and repair of saw chain, since any link which is asymmetrical in construction presents a possibility, whether the saw chain be assembled manually or with machines, that the link be incorporated in a saw chain with such reversely oriented in the chain. When this occurs, the saw chain must be broken apart and the malplaced link replaced. Procedures incorporated into a manufacturing process to prevent this misplacement add to the expense of the chain. Further, there are costs involved in making a replacement when such is necessary. In a preferred embodiment, the drive link is symmetrical while, nevertheless, providing an aggressive cleaning action irrespective of which end of the link is the leading end with the link finally positioned in the saw chain.

BRIEF DESCRIPTION OF THE DRAWINGS

These and other objects and advantages are attained by the invention, which is described hereinbelow in conjunction with the accompanying drawings, wherein.

DETAILED DESCRIPTION OF A PREFERRED EMBODIMENT

Figure 1:
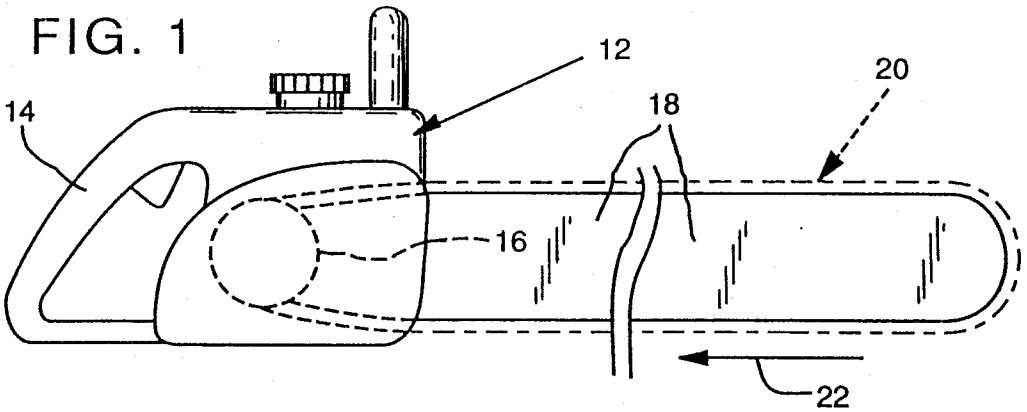
FIG. 1 is a simplified illustration, showing a chain saw which includes a saw blade projecting from a frame and motor unit of the chain saw and having a saw chain trained over the saw blade.

Referring now to the drawings, a typical chain saw, as illustrated in FIG. 1, includes a frame and motor unit 12 equipped with one or more handles 14 used by the operator in manipulating the chain saw. The frame and motor unit includes the usual motor, usually an internal combustion engine, but, in some instances, an electric motor, which, with running of the unit, rotates a sprocket, indicated generally at 16.

Suitably secured to the frame and motor unit, and projecting outwardly therefrom, is a chain saw bar 18. Trained over top and bottom expanses of the chain saw bar and over the nose of the bar, as well as around sprocket 16, is a saw chain 20.

With operation of the chain saw, the saw chain is moved in the direction of the arrow shown in FIG. 1 at 22, with rotation of the sprocket 16 in a clockwise direction.

Figure 4:
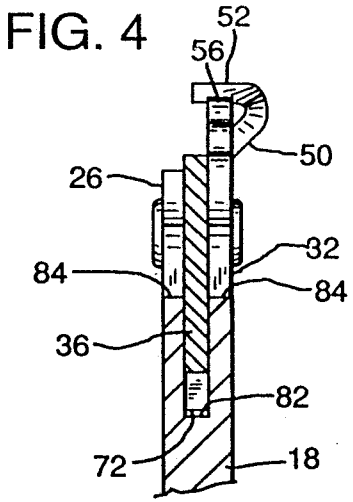
FIG. 4 is a cross-sectional view, taken generally along the line 4—4 FIG. 2.
Figure 2:
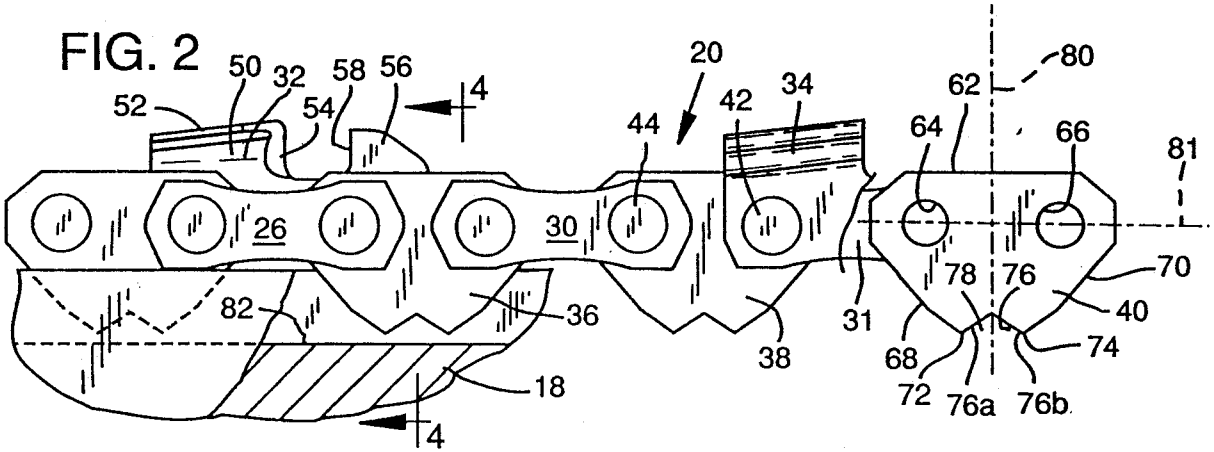
FIG. 2 is a side view on an enlarged scale, illustrating a portion of saw chain including drive links, as contemplated by a preferred embodiment of the invention.
Figure 3:
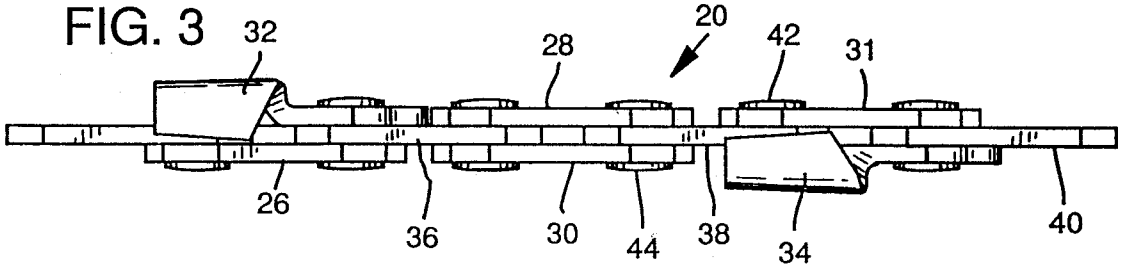
FIG. 3 is a view looking downwardly on the saw chain illustrated in FIG. 2.

A saw chain, as contemplated herein and referring to FIGS. 2, 3 and 4, has side links disposed on opposite sides of the chain. More specifically, these include tie-strap links, shown at 26, 28, 30 and 31, and cutter links, as exemplified by the cutter links shown at 32 and 34. These side links are disposed as pairs distributed along the length of the chain, with tie-strap link 26 and cutter link 32 being preceded in the chain by pairs of tie-strap links 28 and 30, and these paired links, in turn, being preceded by tie-strap link 31 and cutter link 34.

Interspersed with the paired side links are center links which function as drive links, indicated at 36, 38 and 40. Each center link, as exemplified by center link 38, has a forward extremity sandwiched between the rear extremities of opposed side links, i.e., links 31 and 34, and is pivotally connected to these side links by a rivet 42. Each center link has its rear extremity sandwiched between the forward extremities of a succeeding pair of side links, as exemplified by tie-strap links 28 and 30, and is pivotally connected to these side links by a rivet 44.

In the chain, and as illustrated in FIG. 2, with the chain moved under power, the chain moves from left to right. Cutter link 34 is a right-hand cutter link, in that its base is disposed on the right side of the chain as the chain is moved in a cutting direction. On the other hand, cutter link 32 is a left-hand cutter link, with its base being located on the left side of the chain. As is usual with saw chain, the left- and right-hand cutter links are interspersed with each other, with a left-hand cutter link followed by a right-hand cutter link and this link in turn followed by a left-hand cutter link, etc.

A cutter link, and as demonstrated by left-hand cutter link 32, includes an outwardly inclined shank portion 50 which curves thence to join with an inwardly and transversely extending blade or toe portion 52. The leading edge of the shank and toe portion is sharpened, as shown at 54. A depth gauge 56 is spaced forwardly of the sharpened cutting edge of the cutter link, with the depth gauge separated from the shank and toe portion by a gullet 58. A right-hand cutter link is similar, save that its shank portion inclines outwardly on the opposite side of the chain, with its blade or toe portion joining with the shank portion and extending inwardly in the opposite direction.

The center links which appear along the center of the chain progressing along its length, and referring to center link 40, include an upper edge expanse which forms the top of the link, as shown at 62. Adjacent to but spaced downwardly from this upper edge expanse, and located adjacent opposite extremities of the link, are bores, such as those shown at 64, 66. These receive the rivets connecting the center link with side links. Progressing downwardly from the region of bores 64, 66, opposite margins of the link converge on each other, as shown by margins 68, 70, whereby, in side view and in profile, the link has a somewhat heart shape. At the base of the link, a pair of prongs 72, 74 are provided. Between these prongs and bottoming the link between the prongs is an upwardly indented edge expanse 76 defining a cavity 78 which faces downwardly in the link. In the modification shown in FIG. 2, edge expanse 76 comprises a pair of essentially straight edge segments 76*a*, 76*b*. These edge segments form sides of prongs 72, 74, respectively.

The link is a planar element, in that such may be stamped from a sheet of metal and extends in a plane. The link preferably is also symmetrical with respect to a bisecting plane, shown at 80, which bisects the link and extends normal to a line joining the centers of bores 64, 66.

The link, as illustrated, is not a cutting link. The link extends no farther upwardly than its upward extent in regions directly above bores 64, 66. In fact, in the link illustrated, edge expanse 62 extends as a straight line between these upper regions.

Explaining the operation of the chain, during use the chain is mounted on bar 18 with the depending lower extremities of the center links or drive links projecting downwardly into the grooves provided along opposite margins of the saw bar, as exemplified by groove 82 shown in FIGS. 2 and 4. The chain rides along the bar with the bottoms of the side links traveling along the top of the flanges, such as flanges 84, which are on opposite sides of groove 82.

That portion of the chain which extends around sprocket 16 is driven by the sprocket, with the sprocket at this time engaging margins 68 of the respective center links.

During travel of the center links along a groove, such as groove 82, when a link encounters debris which may collect at the base of the groove, such debris is scraped and loosened by the prong 74 which leads the link. Some such material may be moved directly out of the groove through this leading prong. Other material, on being loosened and on passage of the top of the prong thereover, tends to spring up into the region between the prongs and into cavity 78. Such material, and on movement of the rear prong into it, tends to be collected in the cavity and to be ejected by being pulled through the groove by the rear prong.

Should any material be so compacted that the forward prong rides up over it, this tends to result in slight skewing of the link, whereby the rear link dips to engage the material and effectively remove it.

With the center links having a symmetrical configuration, the action of the center link is the same irrespective of whether the link is positioned so that prong 74 is the leading prong or so that this prong is the trailing prong. With prong 74 being the trailing prong with the chain passing over the sprocket, it is margin 70 which is engaged by the sprocket to drive the chain.

With a link of the type described, it is possible to stamp the links from sheet material, with one series of links disposed side-by-side and with another series of links disposed side-by-side and inverted with respect to the first series, and with the links of the other series slightly staggered with respect to the series above it whereby the prongs of the inverted links are in a position straddling a prong in a link thereabove. By cutting the links in this manner, there is less wastage of the sheet material as trimmed matter, resulting in economies in link manufacture.

Figure 5:
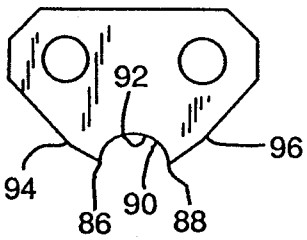
FIG. 5 illustrates a drive link constructed according to a modification of the invention.

In FIG. 5, there is illustrated a modified form of center link. In the link shown in FIG. 5, depending prongs 86, 88 are separated by a cavity 90 defined by an arcuate edge 92. Extremities of this arcuate edge, together with side margins 94, 96 of the link, converge on each other to define the prongs.

As in the case of the first modification of link, the link so produced may be symmetrical about a plane which bisects it. This enables the link to be positioned in the chain with either margin 94 constituting the leading margin or with margin 96 constituting the leading margin, as the chain is drawn across the saw bar.

While various modifications of the invention have been described, it should be obvious that other variations and changes are possible within the spirit of the invention.

It is claimed and desired to secure by Letters Patent:

1. A drive link for power-driven saw chain, the link including a forward edge forming the front of the link, a rear edge forming the rear of the link and an upper edge forming the top of the link, bores adjacent the front and the rear of the link for joining the link to other links, a concave arcuate bottom edge forming the base of the link, said bottom edge having a forward portion and said forward edge having a lower front portion and said forward and lower front portions joining to form a pointed prong adjacent the front of the link, said bottom edge having a rear portion and said rear edge having a lower rear portion and said rear and lower rear portions joining to form a pointed prong adjacent the rear of the link, said forward and rear portions of said bottom edge forming acute angles with respect to a line extending through the ends of said prongs and the lower front portion of said forward edge and lower rear portion of said rear edge defining an acute angle with respect to a line joining said prongs and the acute angles defined by said forward and rear portions of said bottom edge being at least as great as the acute angles defined by the lower front portion and lower rear portion of said forward and rear edges, the link being symmetrical with respect to a plane bisecting a line joining centers of said bores.

2. A drive link for power-driven saw chain, the link including a forward edge at the front end of the link forming the front of the link, a rear edge at the rear end of the link forming the rear of the link and an upper edge forming the top of the link, a pair of bores at the front and rear ends of the link, respectively, for joining the link to other links, an upwardly indented bottom edge forming the base of the link, said bottom edge having a forward portion and said forward edge having a lower front portion and said forward and lower front portions joining to form a pointed prong adjacent the front of the link, said bottom edge having a rear portion and said rear edge having a lower rear portion and said rear and lower rear portions joining to form a pointed prong adjacent the rear of the link, said forward and rear portions of said bottom edge forming acute angles with respect to a line extending through the ends of said prongs and the lower front portion of said forward edge and lower rear portion of said rear edge defining an acute angle with respect to a line joining said prongs and the acute angles defined by said forward and rear portions of said bottom edge being at least as great as the acute angles defined by the lower front portion and lower rear portion of said forward and rear edges, the link being symmetrical with respect to a plane bisecting a line joining centers of said bores, and in combination with said drive link, paired side links pivotally joined at said bores to the front end of the drive link and paired side links pivotally joined through the other of said bores to the rear end of the drive link.

* * * * *